US006183286B1

(12) United States Patent
Hofmann

(10) Patent No.: US 6,183,286 B1
(45) Date of Patent: Feb. 6, 2001

(54) CONVERTIBLE LAMP SOCKET

(75) Inventor: Jürgen Hofmann, Eisenberg (DE)

(73) Assignee: TRW Automotive Electronics & Components GmbH & Co. KG (DE)

( * ) Notice: Under 35 U.S.C. 154(b), the term of this patent shall be extended for 0 days.

(21) Appl. No.: 09/256,833

(22) Filed: Feb. 24, 1999

(30) Foreign Application Priority Data

Feb. 25, 1998 (DE) ..... 198 07 952

(51) Int. Cl.[7] ..... H01R 13/625
(52) U.S. Cl. ..... 439/336
(58) Field of Search ..... 439/336, 335, 439/332, 296, 672, 671, 660, 314, 312

(56) References Cited

U.S. PATENT DOCUMENTS 4,804,343 * 2/1989 Reedy ..... 439/854
5,087,213 * 2/1992 Drapcho et al. ..... 439/672
5,593,324 * 1/1997 Ito ..... 439/672

FOREIGN PATENT DOCUMENTS 0 718 933 A1 6/1996 (EP) .
2 483 137 5/1980 (FR) .
2 702 601 9/1994 (FR) .

* cited by examiner

*Primary Examiner*—Steven L. Stephan
*Assistant Examiner*—Eugene G. Byrd
(74) *Attorney, Agent, or Firm*—Fay, Sharpe, Fagan, Minnich & McKee, LLP

(57) ABSTRACT

A lamp socket system 1 is provided for mounting an associated lamp 20, 20' by holding a base 15 of the lamp through engagement between a set of connection pins 8, 8' extending outwardly from the lamp base and a set of bayonet catch contacts 17, 18. The lamp socket includes a main housing body 2 and a substantially cylindrical coding ring 3, 3' selectively connectable with the housing. The cylindrical coding ring 3 includes a set of recesses 10, 10' arranged on an inner circumference of the coding ring at positions corresponding with positions of the set of connection pins 8, 8' extending from the associated lamp socket base 15. The set of recesses 10, 10' are adapted to receive the set of bayonet catch contacts 17, 18 associated with the lamp socket. A plurality of cylindrical coding rings are provided for selective connection with the main housing body to provide a convertible lamp socket system.

16 Claims, 2 Drawing Sheets

CONVERTIBLE LAMP SOCKET

BACKGROUND OF THE INVENTION

The subject invention is directed to the electric lamp socket art and, more particularly, to a convertible lamp socket that is adaptable for use with electric lamps and bulbs having a wide variety of lamp base end configurations.

Lamp sockets of the type under consideration are commonly used to support lamps that have a metallic base portion including at least a pair of radially extending contact or connection pins. Typically, the electric lamps are held in place relative to the lamp socket through engagement of the connection pins with bayonet-type catch and electromechanical contact members arranged in the lamp socket.

Those skilled in the electric lamp arts know that a wide variety of electric lamps are available, each having a different or slightly different contact pin arrangement on their base ends. As an example, in the automotive vehicle arts, brake light lamps and turn signal indicator lamps have two or more connection pins extending radially outwardly from the metallic base portion of the bulbs. The connection pins can, in one example, be arranged on diametrically opposite sides of the lamp base end. In other bulb types, the connection pins can be arranged at positions offset circumferentially from strict diametric opposite positions. In still other bulbs, the connection pins are often positioned laterally offset relative to each other along the longitudinal axis of the lamp.

One major disadvantage of these known constructions is that, based on the variety of connection or contact pin configurations on the lamp sockets of the respective lamps, specifically designed lamp sockets are required for each lamp type in order to fasten or mount the lamp in the appropriate position. One result is that a large inventory of lamp socket parts are needed in order to accommodate the specific needs of each of the individual electric lamp types. In addition to large inventory requirements, it is often difficult to quickly ascertain which bulbs are to be used with particular sockets and, conversely, which sockets are to be used with particular bulbs.

In contrast to the above, the present invention provides a convertible lamp socket of the above-mentioned type that is easily configured for use with a wide variety of bulb styles. The subject convertible lamp socket facilitates a simplification with respect to lamp socket application for a wide variety of differently shaped bulbs. A single main housing body is provided together with a plurality of interchangeable bulb coding rings.

SUMMARY OF THE INVENTION

The subject invention provides a lamp socket for receiving a base of an associated lamp and holding the lamp base relative to the socket with a set of bayonet catch contacts carried on the lamp socket. The lamp socket includes a main housing body and a substantially cylindrical coding ring selectively connectable with the housing and having a set of recesses arranged on an inner circumference of the coding ring at positions corresponding with positions of the set of connection pins carried by the associated lamp socket base. A plurality of cylindrical coding rings are provided, each being adapted to operate with a particular bulb configuration. The coding rings are interchangeable in the main housing body. The main housing body is adapted to selectively receive any one of the plurality of coding rings so that the resultant lamp socket is convertible to match bulb type.

A primary advantage and benefit of the convertible lamp socket according to the present invention is that only a single main housing body is required in application for all conceivable lamp socket types. By means of the set of interchangeable coding rings arranged in the housing body, the present invention ensures that the main housing body of the subject convertible lamp socket can be adapted to accommodate the connection pin arrangement of nearly all electric lamps. The range of electric lamps that can be accommodated in the subject convertible lamp socket is based on the number of coding rings that are available. Preferably, the coding rings are designed to correspond to the connection pin arrangement of each electric lamp type. It is a benefit of the present invention that by merely mounting a one of the plurality of coding rings on the main body housing, a lamp socket is provided which is particularly adapted to accommodate the electric lamp bulb with which the coding ring is associated.

In accordance with a more limited aspect of the invention, the coding ring is substantially cylindrical in shape and includes a set of recesses formed on the inner circumference thereof. The recesses are positioned at locations that correspond to the arrangement of the outwardly extending connection tabs extending from the base of the electric lamp. In one form, the recesses include a longitudinal groove or initial receiving area that extends substantially in parallel with the longitudinal axis of the lamp socket and coding ring. The recesses further define a transverse end zone that defines a bayonet catch recess extending substantially tangentially to the cylindrical coding ring.

In accordance with a further aspect of the invention, the main housing body includes a cylindrical exterior wall member which defines a set of locating recesses positioned thereon to receive a corresponding set of locating tabs disposed on the outer circumference of the coding ring. Preferably, a set of three locating recesses are defined in the outer wall member of the main housing body and, correspondingly, a set of three locating tabs are distributed circumferentially over the outer surface of the coding ring. In that way, the plurality of coding rings and the housing are connectable in predetermined orientations.

In accordance with a still further aspect of the invention, a set of locating recesses are formed in the housing and a corresponding set of locating tabs are formed on the coding ring. At least one recess and at least one tab extend directly outwardly in a radial direction. In addition, at least one of the locating recess and tab pairs are formed to extend tangentially. It is a benefit of the present invention that as a result of the allocation of the tangentially and radially extending locating recess and tab pairs, a functionally secure mounting of the respective coding rings together with the main housing body of the convertible lamp socket is always assured.

In accordance with still yet a further aspect of the invention, a pair of tangentially extending locating recesses are provided on the housing and a corresponding pair of locating recesses are formed on a single coding ring opposite from each other. In such an arrangement, depending upon the design of the coding ring, the opposite tangential locating tabs may abut either the inner wall or the outer wall of the locating recess formed on the housing, whereby it is possible to employ different perforation geometries in locating recesses of the socket with the same lamp socket main housing body.

It is another benefit of the invention that, in order to attach the respective coding rings in a functionally secure manner to the lamp socket base, the ring shaped outer wall of the main housing body as well as the outer circumference of the respective coding ring is provided with at least one catch element and a counter catch element. The catch and counter catch elements are preferably spaced apart circumferentially over the outer circumference of the coding ring and the main housing body. In one form, the coding ring holds the catch elements and the ring shaped outer wall of the main housing body carries the counter catch elements. In another form, the coding ring holds the counter catch elements and the main housing body carries the catch elements. Preferably, the catch elements are embeddable by means of a catch lug formed on the free end of a resilient catch element arm. The catch lug is adapted to latch into a respective recess formed in the opposite counter catch element.

Still further yet in accordance with the invention, the electrical contacts typically used to establish electrical connection in lamp sockets of the type under consideration are carried in the main housing body of the subject convertible lamp socket. Preferably, the electrical contacts are embedded in the bayonet catch recesses of the respective coding ring.

Still further, in order to securely seal the subject convertible lamp socket, the main housing body is provided with a circumferential flange formed below the ring-shaped outer wall member. The circumferential flange is preferably designed as a support for holding a gasket type sealing ring in a suitable position relative to the lamp socket and the associated bulb. Still yet, to assist in locating the coding ring on the housing body, the coding ring carries a circumferential shoulder defining a front surface that is adapted to engage the face or edge of a corresponding outer wall of the ring-shaped housing body. In that way, the coding ring is securely mounted in firm engagement with the housing body.

Still yet further, in order to selectively attach the respective set of coding rings on the housing body, a plurality of inwardly protruding spacer strips are distributed over the inner circumference of the housing body extending in a longitudinal direction. The spacer strips are adapted to engage the outer circumference of the coding ring when the coding ring is received in the main housing body. The spacer strips assist in locating the coding ring centrally relative to the main housing body so that the pair remain in a secure relative connected position.

As can be seen from the foregoing, a primary object of the invention is the provision of a convertible lamp socket arrangement that is readily adaptable for use with a wide range of associated electric lamps having a wide variety of lamp base configuration types.

A further object of the invention is the provision of a system for selectively connecting a one of a plurality of coding rings to a main housing body to collectively form a convertible lamp socket for use with a wide range of lamp configuration types. The interconnection between the main housing body and the coding rings includes a set of corresponding location recesses and tabs formed on the housing body and coding rings so that the housing body and interchangeable coding ring elements of the subject lamp socket can be easily interconnected in predetermined orientations repeatably.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENTS

Figure 6:
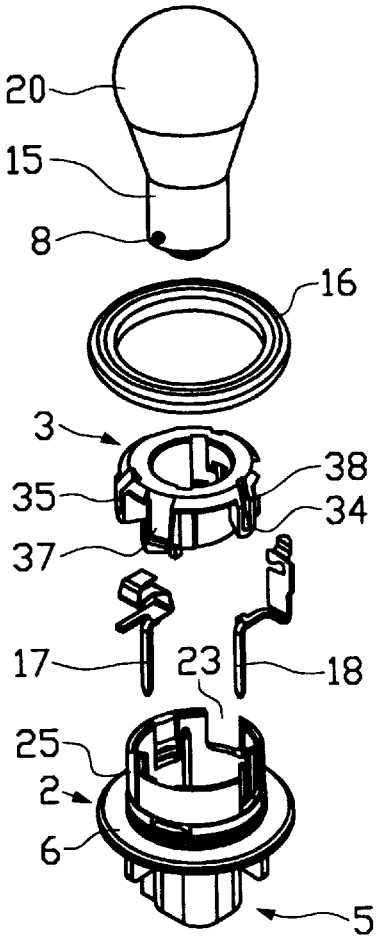
FIG. 6 is an exploded view of the subject convertible lamp socket system formed in accordance with the present invention and illustrating an associated bulb, gasket, and connection pins used therewith.
Figure 7:
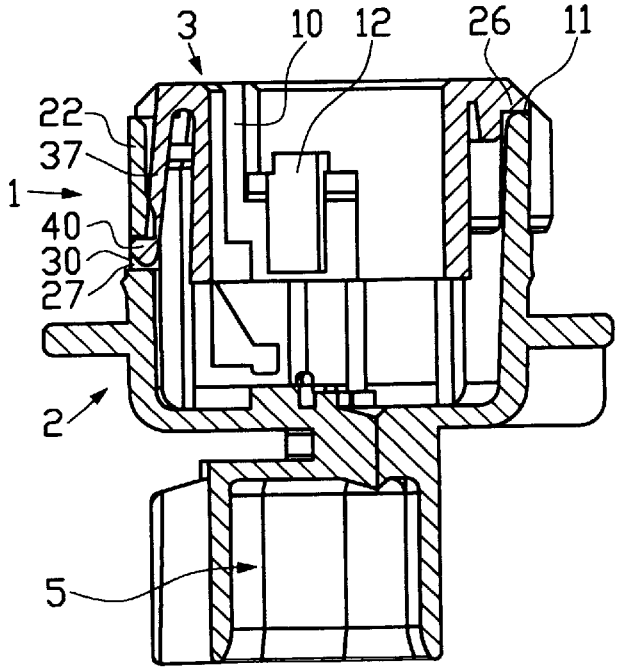
FIG. 7 is a cross-sectional view showing the coding ring illustrated in FIG. 2 received in the main housing body illustrated in FIG. 1; and, FIG. 8 is an isometric perspective view showing the subject lamp socket with the coding ring received in a main housing body illustrating an alternative "L" shaped main housing body type.

Referring now to the drawings wherein the showings are for the purposes of illustrating the preferred embodiments of the invention only and not for purposes of limiting same, the overall arrangement of the preferred form of the convertible lamp socket system formed in accordance with the invention can best be seen by reference to FIGS. 6 and 7. As shown therein, the lamp socket system 1 includes a main housing body 2 and a coding ring 3 connectable with the main housing body.

Figure 4:
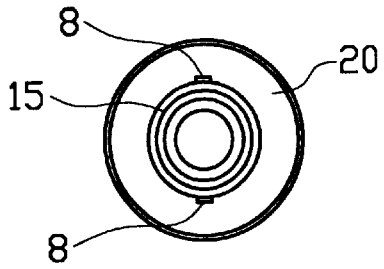
FIGS. 4 and 5 show bottom plan views of a pair of associated lamp bodies illustrating a variety of exemplary connection pin arrangements.
Figure 5:
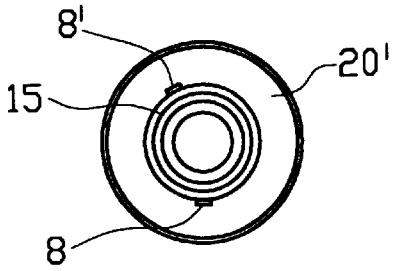

Preferably, in accordance with the invention, the main housing body 2 is adapted to selectively receive one of a plurality of coding rings 3, 3' (FIGS. 2 and 3), each of the plurality of interchangeable coding rings being adapted to match the base end configuration of different lamp types. As an example, FIG. 4 shows a first lamp 20 having a pair of connection pins 8 extending from diametrically opposite sides of a base end 15 thereof. Another lamp style is shown in FIG. 5 whereat a pair of contact pins 8, 8' are shown extending in slightly offset locations from two diametrically opposite positions. That is, the lamp 20' shown in FIG. 5 includes two contact pins 8 and 8' that are offset relative to each other. The contact pins may be offset along the longitudinal axis of the bulb 20' as well.

It is apparent from FIG. 7 that the subject lamp socket 1 includes a main housing body 2 and a coding ring 3 that is mechanically received in the main housing body. As noted above, it is a benefit of the present invention that the main housing body 2 is adapted to selectively receive a plurality of coding rings including the coding ring 3' illustrated in FIG. 3 and others as well. It is to be noted that the first coding ring 3 is adapted to receive the first bulb 20 shown in FIG. 4. Further, the second coding ring 3' illustrated in FIG. 3 is adapted to receive the second exemplary lamp style 20' illustrated in FIG. 5. In either case, the single main housing body 2 is adapted to receive a one of the first or second coding rings 3, 3' or, further, additional coding rings that are not shown in the figures but are contemplated in accordance with the present invention.

Figure 2:
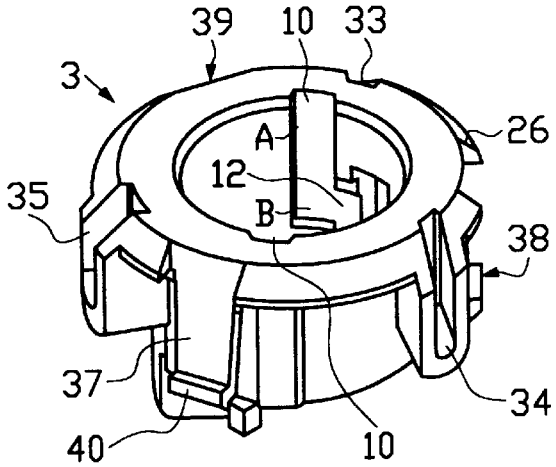
FIG. 2 is an isometric perspective view of a first coding ring adapted for connection with the main housing body shown in FIG. 1 in accordance with the present invention.
Figure 3:
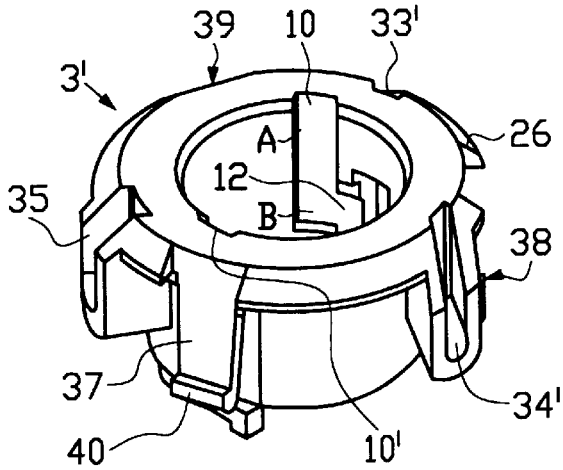
FIG. 3 is an isometric perspective view of a second coding ring adapted for connection with the main housing body shown in FIG. 1 in accordance with the present invention.

With reference next to FIGS. 2 and 3, the coding rings 3 and 3' have a substantially cylindrical shape. Preferably, each of the coding rings have, on their inner circumference, a set of recesses 10 that are disposed on the coding ring at positions that correspond to the locations of the connection pins carried on the exemplary associated lamps 20, 20'. Each of the set of recesses includes a longitudinal first groove A opened on one end at an edge above the coding ring to enable the associated lamp base 15 and the coding ring to be interengaged. Preferably, the first groove A extends substantially in parallel with a first longitudinal axis defined by the bulb and coding ring to permit relative motion between the coding ring and the associated bulb along the first longitudinal axis. Further, each of the set of recesses 10 includes a transverse second groove B defining a bayonet catch recess 12 contiguous with the first groove A and extending tangentially relative to the coding ring 3. The transverse second groove B permits relative interengaged rotational movement between the coding ring and the associated lamp about the longitudinal axis of the lamp and ring.

As best shown in FIG. 6, the subject lamp socket system 1 is provided with a set of electrical contact pins 17 and 18. Preferably, the bayonet catch recesses 12 of the coding rings 3 and 3' are adapted to receive the set of electrical contacts 17 and 18 so that, in the assembled condition, the electrical contacts are carried by the bayonet catch recesses and held in a predetermined position relative to the lamp socket to engage the respective connection pins 8 or 8' of the associated lamps to establish mechanical and electrical contact therewith.

Figure 1:
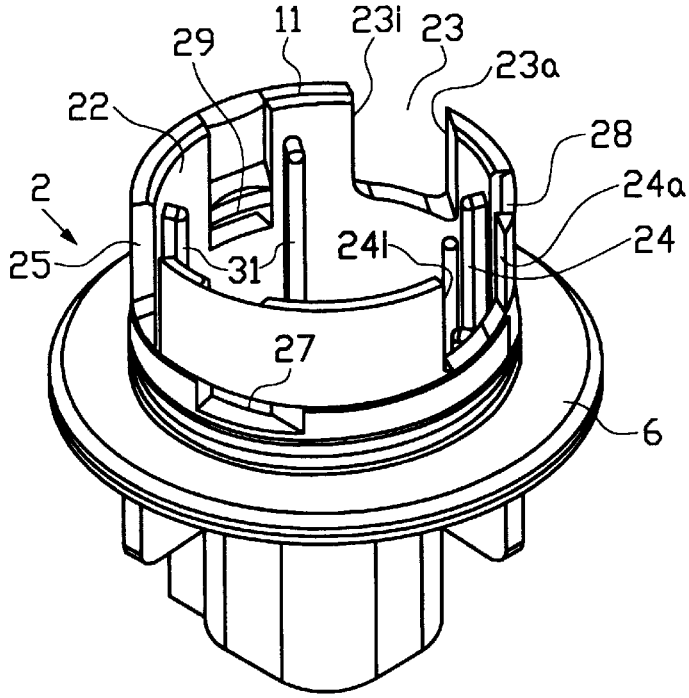
FIG. 1 is an isometric perspective view showing the overall arrangement of the main housing body of the subject convertible lamp socket formed in accordance with the present invention.

As is apparent from FIGS. 1 and 7, the main housing body 2 is substantially cylindrical in shape and includes, on its upper region, a ring-shaped outer wall member 22 provided with a set of three circumferentially spaced apart locating recesses 23, 24, and 25. The locating recesses are adapted to receive a corresponding set of locating tabs 33, 34, and 35 of the first coding ring 3 and locating tabs 33', 34', and 35' of the second coding ring 3'. The locating tabs are shown in FIGS. 2 and 3 as being formed on the outer circumference of the respective coding rings 3, 3'. Although a set of three locating recesses and tabs are shown, two may be used. Alternatively, four or more recess and tab pairs may be used as well.

As best shown in FIGS. 1, 2, and 3, a first locating recess 25 of the housing and locating tab 35 formed on the coding rings 3 or 3' are formed to extend directly radially outward relative to the longitudinal axis of the coding ring and main housing body. A pair of locating recesses 23 and 24 of the housing 2 and two locating tabs 33 and 34 are positioned generally opposite from the central locating recess 25 and locating tab 35. Similarly, the pair of locating tabs 33' and 34' are positioned on the second coding ring 3' opposite the central locating tab 35'. In that way, the pair of locating recesses 23 and 24 formed in the main housing body 2 are adapted to receive either the first pair of locating tabs 33, 34 formed on the first coding ring 3 or, alternatively, the second set of locating tabs 33', 34' carried on the second coding ring 3'. As shown in the figures, the locating tabs 33 and 34 as well as 33' and 34' are shaped to extend tangentially outwardly from the respective coding ring 3 or 3'.

With respect to the first coding ring 3 illustrated in FIG. 2, the recesses 10 formed therein are adapted to receive opposite contact pins 8—8 of the first lamp 20. In addition, the pair of tangentially extending locating tabs 33 and 34 are formed relatively close together and are centered on a position diametrically opposite from the outwardly radially extending locating tab 35. In that way, when the coding ring 3 is assembled into the main housing body 2, the outer sides of the tangentially extending locating tabs 33 and 34 abut the inner wall **23*i* and 24*i* of the two recesses 23 and 24 defined in the main housing body 2**.

In connection with the second coding ring 3' illustrated in FIG. 3, the pair of tangentially extending locating tabs 33' and 34' are moved apart from one another relative to a position opposite the radially extending recess 35'. In that way, when the second coding ring 3' is assembled into the main housing body 2, the spaced apart tangentially extending locating tabs 33' and 34' abut the outer walls **23*a* and 24*a* of the locating recesses 23 and 24 formed in the main housing body 2. The above described tangentially directed tabs guarantees, in a simple fashion, a correct and trouble-free mounting of the respective coding rings 3 or 3' in the main housing body 2**.

In order to ensure a positive and tight connection between the coding rings 3 or 3' in the main housing body 2 of the subject lamp socket 1, each of the coding rings 3 and 3' in the present exemplary embodiment includes a set of catch elements 37, 38, and 39 which are circumferentially distributed over the outer side of the cylindrical coding ring. Preferably, as illustrated, each of the catch elements carries a catch lug 40 on the lower free end thereof. The catch elements are preferably resilient and are adapted to flex radially inwardly as the coding ring and main housing body are brought into their intermated connected positions.

In order to provide a secure connection between the coding ring and housing body, the ring-shaped outer wall member 22 of the main housing body 2 includes corresponding counter catch elements 27, 28, and 29. Each of the counter catch elements includes, in its lower region, a recess 30 shown in FIGS. 1 and 7. The recesses 30 are adapted to receive the corresponding catch lugs 40 when the resilient catch elements spring outwardly in their unloaded orientation.

Although the preferred connection between the coding ring and main housing body described above includes three elastic catch elements 37, 38, and 39 and a corresponding set of counter catch elements 27, 28, and 29, it also possible to connect the coding ring and the main housing body using only a pair of opposing catch and counter catch elements. It is also conceivable and within the scope of the instant application to equip the outer wall of the housing with the catch elements and to provide the coding rings 3 and 3' with the corresponding counter catches. A mixture of catch elements and counter catch elements could be provided on coding ring and main housing body. An equivalent connection is established in either case.

As is apparent with reference to FIGS. 2 and 3, the longitudinal length of the locating tabs 33, 34, and 35 or 33', 34', and 35' is shorter than the length of the catch elements 37, 38, and 39. Consequently, the catch elements, as best shown in FIG. 7, engage with the corresponding counter catches of the housing 2 along the longitudinal axis below the lamp socket. This provides a stable connected assembly.

As is particularly apparent with reference to FIGS. 1, 6, and 7, the main housing body 2 includes a circumferential radially extending flange 7 disposed below the ring-shaped outer wall member 22. The circumferential flange 6 is preferably shaped and positioned to provide a support surface for an associated sealing ring 16. The sealing ring forms a gasket-type interface and results in a tightly sealed fastening of the lamp socket to an associated support member. FIG. 7 shows the associated gasket-type sealing ring 16 received on the circumferential radially extending flange 6.

As shown in FIG. 7, the coding ring 3 (or 3') includes a shoulder 26 that is adapted to extend over and engage the front face surface or edge 11 of the ring-shaped outer wall member 22. In the mounted or interconnected position shown in FIG. 7, the shoulder 26 extends radially outwardly to substantially close the assembly between the coding ring 3 and the housing 2 of the lamp socket 1. The shoulder 26 provides a nearly closed assembled unit.

In order to provide additional mechanical integrity and to assist in locating the coding ring centrally within the main housing body, the inside circumferential surface of the main housing body 2 is provided with a plurality of longitudinally extending spacer strips 31 distributed thereover. In the mounted position, the respective coding ring 3 or 3' is arranged functionally secure in the interior of the main housing body 2 of the lamp socket 1 through contact with the longitudinal spacer strips 31.

Figure 8:
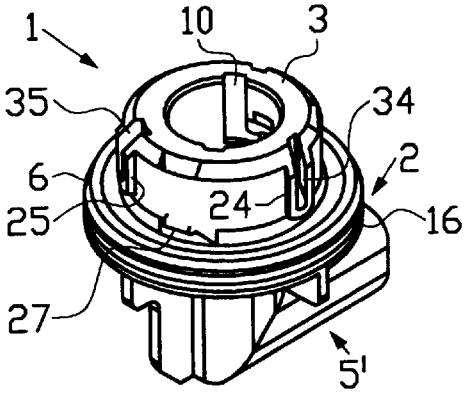

In the exemplary embodiment of the main housing body 2 shown in FIGS. 1 and 7, a connector body 5 is provided extending substantially along the longitudinal axis defined by the housing body and coding ring. The respective associated contact pins 17 and 18 are arranged to extend along the longitudinal axis as well. However, a shown in FIG. 8, a connection 5' is provided positioned at a 90° angle relative to the longitudinal axis of the respective lamp socket. The main housing body 2 of the lamp socket shown in FIG. 8, analogous to the lamp socket described above, is adapted to selectively accept a coding ring 3 or 3' adapted to respectively receive a particular lamp base configuration.

In accordance with the present invention, the subject lamp socket is particularly suitable for connection with a plurality of automotive indicator lights such as brake lamps, turn signal lamps, or the like, regardless of whether two or three contact pins are used. By interaction of the respective coding rings with the corresponding contacts and the contact pins of the respective lamp sockets, and, further, by the arrangement of the bayonet-type catch mechanisms, uniform and secure electrical contact is established. When the respective lamp is inserted into the subject lamp socket, secure fastening of the socket 1 is assured by rotating the lamp about the longitudinal axis whereby, simultaneously, electrical and mechanical contact is guaranteed between the contact pins 8 and the connection pins 17 and 18.

The invention has been described with reference to the preferred embodiment. Obviously, modifications and alterations will occur to others upon a reading and understanding of this specification such as, for example, by providing housing bodies and coding rings that have shapes other than the circular configurations shown. It is intended to include all such modifications and alterations insofar as they come within the scope of the appended claims or the equivalents thereof.

Having thus described the invention, it is claimed:

1. A convertible lamp socket for mounting a plurality of differently shaped associated lamps by holding a base of a selected lamp through engagement between a set of connection pins extending outwardly from the lamp base and a set of bayonet catch contacts associated with the selected lamp socket, the lamp socket comprising:

a main housing body including a cylindrical wall member defining a plurality of circumferentially spaced apart locating recesses; and, a substantially cylindrical coding ring defining a first longitudinal axis and being selectively connectable with the housing body, the coding ring carrying a plurality of circumferentially spaced apart locating tabs arranged to engage the locating recesses defined on the wall member when the coding ring and the main body housing are selectively connected together, the coding ring further having a set of recesses arranged on an inner circumference of the coding ring at positions corresponding with positions of the set of connection pins extending from the associated selected lamp socket base, the set of recesses being adapted to receive said set of bayonet catch contacts associated with the selected lamp socket, each set of recesses including i) a longitudinal first groove opened on one end at an edge of the coding ring to enable the associated selected lamp base and the coding ring to be interengaged, the first groove extending substantially in parallel with the first longitudinal axis to permit relative motion between the coding ring and the associated selected lamp along said first longitudinal axis, and ii) a transverse second groove defining a bayonet catch recess contiguous with the first groove and extending tangentially relative to the coding ring, the transverse second groove permitting relative interengaged rotation between the coding ring and the associated selected lamp about said first longitudinal axis.

2. The lamp socket according to claim 1 wherein at least one of the plurality of circumferentially spaced apart locating recesses and at least one of the plurality of circumferentially spaced apart locating tabs are arranged in a direction that extends directly radially outwardly relative to said longitudinal axis defined by the coding ring.

3. The lamp socket according to claim 4 wherein at least one of the plurality of circumferentially spaced apart locating recesses and at least one of the plurality of circumferentially spaced apart locating tabs are arranged in a direction that extends tangentially relative to said longitudinal axis defined by the coding ring.

4. The lamp socket according to claim 1 wherein said plurality of circumferentially spaced apart locating recesses and said plurality of circumferentially spaced apart locating tabs are formed on said wall member of the main housing body and said coding ring, respectively, at locations that the locating tabs contact a one of a first set of longitudinal sidewalls defined by the locating recesses and a second set of longitudinal sidewalls defined by the locating recesses.

5. The lamp socket according to claim 1 wherein said main housing body carries a one of a set of catch elements and a set of counter catch elements and said coding ring carries the other of said set of catch elements and said set of counter catch elements, the set of catch elements and the set of counter catch elements being engageable to selectively connect the main housing body with the coding ring.

6. The lamp socket according to claim 5 wherein said main housing body carries a set of three counter catch elements and said coding ring carries a set of three catch elements, the set of three catch elements and the set of three counter catch elements being engageable to selectively connect the main housing body with the coding ring.

7. The lamp socket according to claim 6 wherein:

each of said set of catch elements include a catch lug member carried on the free end of an elongate resilient member; and, each of said set of counter catch elements include a catch recess adapted to receive a corresponding catch lug member.

8. The lamp socket according to claim 7 wherein said set of three catch elements have a length greater than a length of said plurality of circumferentially spaced apart locating tabs.

9. The lamp socket according to claim 1 wherein said bayonet catch recesses of the coding ring are adapted to receive said set of bayonet catch contacts when the coding ring and the main housing body are selectively coupled together.

10. The lamp socket according to claim 1 wherein the main housing body includes a circumferential radially extending flange member.

11. The lamp socket according to claim 10 wherein said circumferential radially extending flange member is adapted to support a sealing ring relative to the main housing body.

12. The lamp socket according to claim 1 wherein:

the cylindrical wall member of the main housing body forms a substantially circular edge; and, the coding ring includes a shoulder area adapted to substantially cover the substantially circular edge of the cylindrical wall member when the coding ring and the main housing member are selectively coupled together.

13. The lamp socket according to claim 1 wherein the main housing body is substantially cylindrical and includes a set of spacer strip members disposed in a spaced apart relationship on an inner circumference of the housing body and extending along a longitudinal axis of the housing body, the spacer strip members being adapted to contact an outer circumference o the coding ring when the coding ring and the main housing member are selectively coupled together.

14. A convertible lamp socket system for use with at least two associated electric lamps, each of the at least two associated lamps having a different mechanical connection area configuration, the lamp socket system comprising:

a housing member adapted to carry electric current to the at least two associated electric lamps when the at least two associated electric lamps are selectively singularly received in the lamp socket system, the housing member defining a first mechanical receiving area;

a first adapter ring member having a first mechanical engagement area adapted to selectively intermatably couple with a first mechanical connection pin configuration of a first associated electric lamp and having a second mechanical engagement area adapted to selectively intermatably couple with said first mechanical receiving area of said housing member to carry said electric current to the first associated electric lamp; and, a second adapter ring member having a second mechanical engagement area shaped differently from said first mechanical connection area of said first adapter ring member, the second adapter ring member being adapted to selectively intermatably couple with a second mechanical connection pin configuration of a second associated electric lamp and having a second mechanical engagement area adapted to selectively intermatably couple with said first mechanical receiving area of said housing member to carry said electric current to the second associated electric lamp, the first and second adapter ring members being selectively interchangeable in said housing member to selectively adapt the housing member to receive a one of the first and second associated electric lamps.

15. The convertible lamp socket system according to claim 14 for use with a plurality of associated electric lamps, each of the plurality of associated lamps having a different mechanical connection area configuration, the lamp socket system further comprising:

a plurality of adapter ring members each having a second mechanical engagement area adapted to selectively intermatably couple with second mechanical connection pin configurations of said plurality of associated electric lamps and each of the plurality of adapter ring members having a second mechanical engagement area adapted to selectively intermatably couple with said first mechanical receiving area of said housing member to carry said electric current to the plurality of associated electric lamps, the plurality of adapter ring members being selectively interchangeable in said housing member to selectively adapt the housing member to receive a one of the plurality of associated electric lamps having said different mechanical connection area configurations.

16. The convertible lamp socket system according to claim 14 wherein second mechanical engagement area of said first adapter ring member is shaped substantially identical to said second mechanical engagement area of said second adapter ring member.

* * * * *